US007806206B1

(12) United States Patent
Miess

(10) Patent No.: US 7,806,206 B1
(45) Date of Patent: Oct. 5, 2010

(54) SUPERABRASIVE MATERIALS, METHODS OF FABRICATING SAME, AND APPLICATIONS USING SAME

(75) Inventor: David P. Miess, Highland, UT (US)

(73) Assignee: US Synthetic Corporation, Orem, UT (US)

( * ) Notice: Subject to any disclaimer, the term of this patent is extended or adjusted under 35 U.S.C. 154(b) by 80 days.

(21) Appl. No.: 12/070,149

(22) Filed: Feb. 15, 2008

(51) Int. Cl.
*E21B 10/36* (2006.01)
*E21B 10/46* (2006.01)

(52) U.S. Cl. ..... 175/434; 175/428

(58) Field of Classification Search ..... 175/434, 175/426, 428, 433, 420.2
See application file for complete search history.

(56) References Cited

U.S. PATENT DOCUMENTS

| | | | |
|---|---|---|---|
| 3,316,073 | A | 4/1967 | Kelso |
| 3,745,623 | A | 7/1973 | Wentorf, Jr. et al. |
| 3,879,901 | A | 4/1975 | Caveney |
| 4,268,276 | A | 5/1981 | Bovenkerk |
| 4,274,900 | A | 6/1981 | Mueller et al. |
| 4,403,015 | A | 9/1983 | Nakai et al. |
| 4,410,054 | A | 10/1983 | Nagel et al. |
| 4,468,138 | A | 8/1984 | Nagel |
| 4,560,014 | A | 12/1985 | Geczy |
| 4,738,322 | A | 4/1988 | Hall et al. |
| 4,811,801 | A | 3/1989 | Salesky et al. |
| 4,884,477 | A | 12/1989 | Smith et al. |
| 4,913,247 | A | 4/1990 | Jones |
| 5,011,514 | A | 4/1991 | Cho et al. |
| 5,016,718 | A | 5/1991 | Tandberg |
| 5,030,276 | A | 7/1991 | Sung et al. |
| 5,092,687 | A | 3/1992 | Hall |
| 5,120,327 | A | 6/1992 | Dennis |
| 5,135,061 | A | 8/1992 | Newton, Jr. |
| 5,151,107 | A | 9/1992 | Cho et al. |

(Continued)

FOREIGN PATENT DOCUMENTS

| | | |
|---|---|---|
| EP | 0012631 | 6/1980 |

(Continued)

OTHER PUBLICATIONS

Office Action dated Jul. 7, 2009 from U.S. Appl. No. 11/424,674.

(Continued)

*Primary Examiner*—Kenneth Thompson
(74) *Attorney, Agent, or Firm*—Workman Nydegger

(57) ABSTRACT

Embodiments of the present invention relate to superabrasive materials, superabrasive compacts employing such superabrasive materials, and methods of fabricating such superabrasive materials and compacts. In one embodiment, a superabrasive material includes a matrix comprising a plurality of coarse-sized superabrasive grains, with the coarse-sized superabrasive grains exhibiting a coarse-sized average grain size. The superabrasive material further includes a plurality of superabrasive regions dispersed within the matrix, with each superabrasive region including a plurality of fine-sized superabrasive grains exhibiting a fine-sized average grain size less than the coarse-sized average grain size. In another embodiment, the superabrasive materials may be employed in a superabrasive compact. The superabrasive compact comprises a substrate including a superabrasive table comprising any of the disclosed superabrasive materials. Further embodiments are directed to applications utilizing the disclosed superabrasive articles in applications, such as rotary drill bits.

22 Claims, 5 Drawing Sheets

U.S. PATENT DOCUMENTS

| | | | | |
|---|---|---|---|---|
| 5,154,245 | A | 10/1992 | Waldenstrom et al. | |
| 5,364,192 | A | 11/1994 | Damm et al. | |
| 5,368,398 | A | 11/1994 | Damm et al. | |
| 5,460,233 | A | 10/1995 | Meany et al. | |
| 5,468,268 | A | 11/1995 | Tank et al. | |
| 5,480,233 | A | 1/1996 | Cunningham | |
| 5,505,748 | A | 4/1996 | Tank et al. | |
| 5,544,713 | A | 8/1996 | Dennis | |
| 5,855,996 | A | 1/1999 | Corrigan et al. | |
| 5,954,147 | A | 9/1999 | Overstreet et al. | |
| 5,964,100 | A | 10/1999 | Wisniewski | |
| 5,981,445 | A | 11/1999 | Kirchnerova et al. | |
| 6,063,502 | A | 5/2000 | Sue et al. | |
| 6,079,215 | A | 6/2000 | Wisniewski | |
| 6,132,675 | A | 10/2000 | Corrigan et al. | |
| 6,170,269 | B1 | 1/2001 | Wisniewski | |
| 6,454,027 | B1 | 9/2002 | Fang et al. | |
| 6,793,681 | B1 | 9/2004 | Pope et al. | |
| 6,862,890 | B2 | 3/2005 | Williams, III et al. | |
| 6,951,578 | B1 | 10/2005 | Belnap et al. | |
| 7,007,406 | B2 | 3/2006 | Wang et al. | |
| 7,048,081 | B2 * | 5/2006 | Smith et al. | 175/434 |
| 7,211,218 | B2 | 5/2007 | Fang et al | |
| 7,243,744 | B2 | 7/2007 | Griffo | |
| 7,441,610 | B2 | 10/2008 | Belnap et al. | |
| 7,516,804 | B2 * | 4/2009 | Vail | 175/434 |
| 2004/0221515 | A1 | 11/2004 | McArdle et al. | |
| 2005/0019114 | A1 * | 1/2005 | Sung | 407/119 |
| 2005/0051366 | A1 | 3/2005 | Frushour | |
| 2005/0230156 | A1 | 10/2005 | Belnap et al. | |
| 2005/0263328 | A1 | 12/2005 | Middlemiss | |
| 2005/0263388 | A1 | 12/2005 | Lee et al. | |
| 2006/0115408 | A1 | 6/2006 | Akaishi et al. | |
| 2006/0191722 | A1 | 8/2006 | Belnap et al. | |
| 2007/0079992 | A1 | 4/2007 | Curry et al. | |
| 2007/0193782 | A1 | 8/2007 | Fang et al. | |
| 2008/0023230 | A1 | 1/2008 | Cho | |

FOREIGN PATENT DOCUMENTS

| | | | |
|---|---|---|---|
| EP | 0052922 | A1 | 6/1982 |
| EP | 0352811 | | 1/1990 |
| EP | 0365843 | A1 | 5/1990 |
| WO | 0038864 | | 7/2000 |
| WO | 2004040029 | A1 | 5/2004 |
| WO | 2004111284 | A2 | 12/2004 |
| WO | 2008114228 | A1 | 9/2008 |

OTHER PUBLICATIONS

U.S. Appl. No. 11/424,674, Bertagnolli

European Patent Office; International Search Report for PCT/US2007/013782; Written Opinion of the International Searching Authority.

Donve, A., Cisse, I., Sachs, D., Variano, E.A., Stillinger, F.H., Connely, R., Torquato, S., and Chaikin, P.M. (2004). Improving the density of jammed disordered packings using ellipsoids. Science, 303(5660), 990-993.

Mohammad N. Sani, et al., U.S. Appl. No. 12/336,721 titled "Superabrasive Materials and Compacts, Methods Of Fabricating Same, And Applications Using Same" filed Dec. 17, 2008.

Office Action dated Dec. 16, 2008 from U.S. Appl. No. 11/424,674.

Office Action dated Aug. 27, 2008 from U.S. Appl. No. 11/424,674.

U.S. Appl. No. 11/424,674, mailed Jan. 6, 2010, Office Action.

U.S. Appl. No. 11/424,674, mailed May 11, 2010, Office Action.

* cited by examiner

SUPERABRASIVE MATERIALS, METHODS OF FABRICATING SAME, AND APPLICATIONS USING SAME

BACKGROUND

Wear-resistant, superabrasive compacts are utilized in a variety of mechanical applications. For example, polycrystalline diamond compacts ("PDCs") are used in drilling tools (e.g., cutting elements, gage trimmers, etc.), machining equipment, bearing apparatuses, wire-drawing machinery, and in other mechanical systems.

PDCs have found particular utility as superabrasive cutting elements in rotary drill bits, such as roller cone drill bits and fixed cutter drill bits. A PDC cutting element or cutter typically includes a superabrasive diamond layer or table. The diamond table is formed and bonded to a substrate using an ultra-high pressure, ultra-high temperature ("HPHT") process. The substrate is often brazed or otherwise joined to an attachment member, such as a stud or a cylindrical backing. A stud carrying the PDC may be used as a PDC cutting element when mounted to a bit body of a rotary drill bit by press-fitting, brazing, or otherwise securing the stud into a receptacle formed in the bit body. The PDC cutting element may also be brazed directly into a preformed pocket, socket, or other receptacle formed in the rotary drill bit. A rotary drill bit typically includes a number of PDC cutting elements affixed to the bit body.

Conventional PDCs are normally fabricated by placing a cemented-carbide substrate into a container or cartridge with a volume of diamond particles positioned on a surface of the cemented-carbide substrate. A number of such cartridges may be loaded into an HPHT press. The substrates and volume of diamond particles are then processed under HPHT conditions in the presence of a catalyst material that causes the diamond particles to bond to one another to form a matrix of bonded diamond grains defining a diamond table. The catalyst material is often a solvent catalyst, such as cobalt, nickel, iron, or alloys thereof that is used for facilitating the intergrowth of the diamond particles.

In one conventional approach, a constituent of the cemented-carbide substrate, such as cobalt from a cobalt-cemented tungsten carbide substrate, liquefies and sweeps from a region adjacent to the volume of diamond particles into interstitial regions between the diamond particles during the HPHT process. The cobalt acts as a catalyst to facilitate intergrowth between the diamond particles, which results in formation of bonded diamond grains. Often, a solvent catalyst may be mixed with the diamond particles prior to subjecting the diamond particles and substrate to the HPHT process.

The solvent catalyst dissolves carbon from the diamond particles or portions of the diamond particles that graphitize due to the high temperature being used in the HPHT process. The solubility of the stable diamond phase in the solvent catalyst is lower than that of the metastable graphite under HPHT conditions. As a result of this solubility difference, the undersaturated graphite tends to dissolve into solvent catalyst and the supersaturated diamond tends to deposit onto existing diamond particles to form diamond-to-diamond bonds. Accordingly, diamond grains become mutually bonded to form a matrix of polycrystalline diamond with interstitial regions between the bonded diamond grains being occupied by the solvent catalyst.

Despite the availability of a number of different superabrasive materials, manufacturers and users of superabrasive materials continue to seek superabrasive materials that exhibit improved mechanical and/or thermal properties.

SUMMARY

Embodiments of the present invention relate to superabrasive materials, superabrasive compacts employing such superabrasive materials, and methods of fabricating such superabrasive materials and compacts. In one embodiment of the present invention, a superabrasive material includes a matrix including a plurality of coarse-sized superabrasive grains, with the coarse-sized superabrasive grains exhibiting a coarse-sized average grain size. The superabrasive material further includes a plurality of superabrasive regions dispersed within the matrix, with each superabrasive region including a plurality of fine-sized superabrasive grains exhibiting a fine-sized average grain size less than the coarse-sized average grain size.

In another embodiment of the present invention, the superabrasive materials may be employed in a superabrasive compact. The superabrasive compact comprises a substrate including a superabrasive table bonded thereto that comprises any of the disclosed embodiments of superabrasive materials.

In yet another embodiment of the present invention, a superabrasive material or a superabrasive compact may formed. A mixture may be sintered to form a superabrasive material. The mixture includes a plurality of coarse-sized superabrasive particles, with the coarse-sized superabrasive particles exhibiting a coarse-sized average particle size. The mixture further includes a plurality of agglomerates dispersed through the plurality of coarse-sized superabrasive particles, with each agglomerate including a plurality of fine-sized superabrasive particles. The fine-sized superabrasive particles exhibit a fine-sized average particle size that is less than the coarse-sized average particle size.

Further embodiments of the present invention relate to applications utilizing the disclosed superabrasive materials in various articles and apparatuses, such as, rotary drill bits, machining equipment, bearing apparatuses, wire-drawing dies, and other articles and apparatuses.

BRIEF DESCRIPTION OF THE DRAWINGS

The drawings illustrate several embodiments of the present invention, wherein identical reference numerals refer to identical elements or features in different views or embodiments shown in the drawings.

DETAILED DESCRIPTION

Embodiments of the present invention relate to superabrasive materials, superabrasive compacts employing such superabrasive materials, and methods of fabricating such superabrasive materials and compacts. The embodiments of superabrasive materials disclosed herein include a plurality of relatively fine-grained superabrasive regions dispersed within a matrix of relatively coarse-grained superabrasive grains to provide a tough and abrasion resistant superabrasive material. The superabrasive regions provide relatively abrasion-resistant regions and the matrix provides a relatively impact-resistant and/or thermally stable region. The embodiments of superabrasive materials disclosed herein may be used in a variety of applications, such as drilling tools (e.g., compacts, cutting elements, gage trimmers, etc.), machining equipment, bearing apparatuses, wire-drawing machinery, and other apparatuses. As used herein, the term "superabrasive" means a material that exhibits a hardness exceeding a hardness of tungsten carbide.

Figure 1:
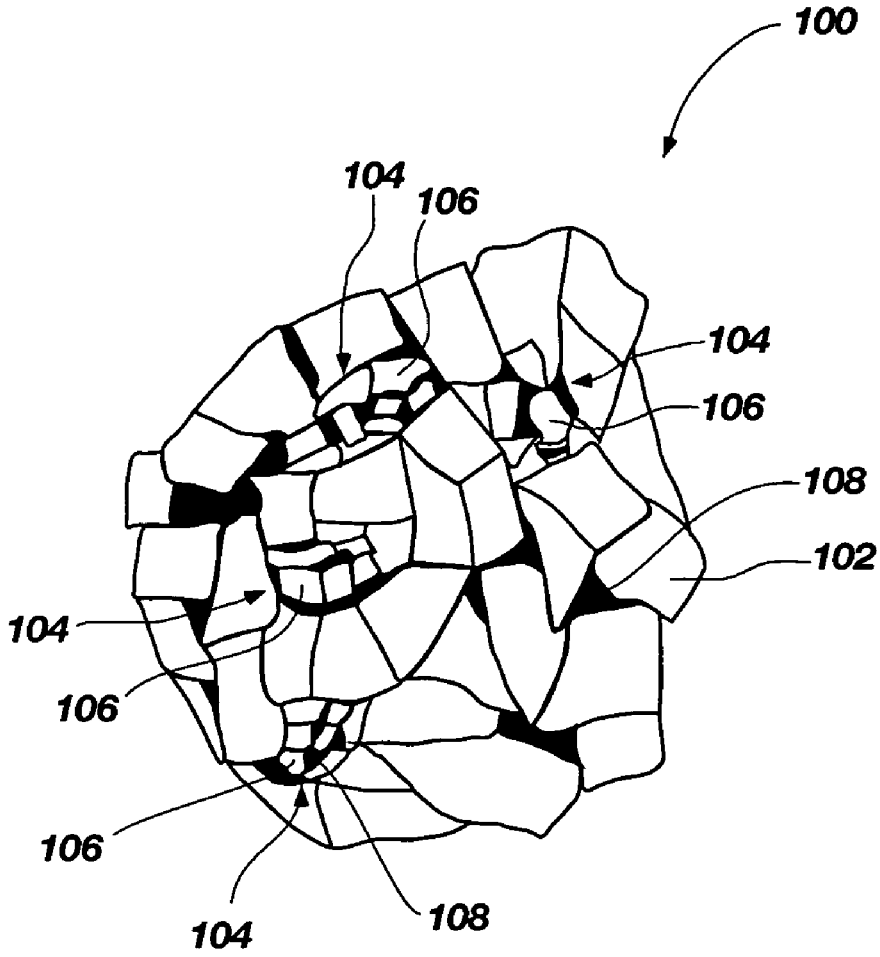
FIG. 1 is a microstructural representation of a superabrasive material according to one embodiment of the present invention.

FIG. 1 is a microstructural representation of an HPHT sintered superabrasive material 100 according to one embodiment of the present invention. The superabrasive material 100 comprises a matrix including a plurality of coarse-sized superabrasive grains 102 that may exhibit a high-degree of intercrystalline bonding (i.e., polycrystalline) between adjacent superabrasive grains 102. A plurality of superabrasive regions 104 are dispersed within the matrix. Depending upon the relative weight percentages of the coarse-sized superabrasive grains 102 and the superabrasive regions 104, in some embodiments, the matrix may be substantially continuous (as illustrated in FIG. 1), with substantially most of the superabrasive regions 104 being completely surrounded by the matrix. In other embodiments, the matrix may be generally discontinuous. Each superabrasive region 104 may exhibit a selected geometry, such as a generally ellipsoid geometry, a generally spherical geometry, a non-spherical geometry, a generally cylindrical geometry, or another selected geometry. Each superabrasive region 104 includes a plurality of fine-sized superabrasive grains 106 that may also exhibit a high-degree of intercrystalline bonding (i.e., polycrystalline) between adjacent superabrasive grains 106. The coarse-sized superabrasive grains 102 and the fine-sized superabrasive grains 106 may comprise diamond grains, cubic boron nitride grains, or mixtures of both. A metal-solvent catalyst 108 (e.g., cobalt, nickel, iron, or alloys of the preceding metals) is disposed within interstitial regions formed between adjacent coarse-sized superabrasive grains 102, adjacent fine-sized superabrasive grains 106, and adjacent coarse-sized superabrasive grains 102 and fine-sized superabrasive grains 106 that may function as a catalyst to promote intergrowth between the superabrasive grains 102, superabrasive grains 106, and/or between the superabrasive grains 102 and 106 during HPHT sintering. In some embodiment, substantially all or a portion of the metal-solvent catalyst 108 may be removed by leaching.

Still referring to FIG. 1, as used herein, the terms "coarse-sized" and "fine-sized" do not refer to a particular size or size range for the coarse-sized superabrasive grains 102 and the fine-sized superabrasive grains 106. Instead, the terms "coarse-sized" and "fine-sized" refer to relative size differences between the coarse-sized superabrasive grains 102 and the fine-sized superabrasive grains 106. For example, the coarse-sized superabrasive grains 102 may exhibit a coarse-sized average grain size of about 6 μm to about 30 μm (e.g., about 6 μm to about 20 μm), and the fine-sized superabrasive grains 106 may exhibit a fine-sized average grain size of about 6 μm or less. Thus, the fine-sized average grain size of the fine-sized superabrasive grains 106 of the superabrasive regions 104 is substantially smaller grain size than that of the coarse-sized average grain size of the coarse-sized superabrasive grains 102 through which the superabrasive regions 104 are dispersed. In some embodiments of the present invention, the coarse-sized average grain size of the coarse-sized superabrasive grains 102 is about five times or more than the fine-sized average grain size of the fine-sized superabrasive grains 106. Additionally, in some embodiments, the coarse-sized superabrasive grains 102 may exhibit a bimodal or greater size distribution, while the coarse-sized average grain size is still greater than that of the fine-sized average grain size. However, an average size (i.e., a diameter or other cross-sectional dimension) of the superabrasive regions 104 may be about 50 μm to about 200 μm.

The superabrasive regions 104 provides the superabrasive material 100 with relatively high-abrasion resistant regions, while the matrix comprising the coarse-sized superabrasive grains 102 provides the superabrasive material 100 with a relatively impact-resistant and/or thermally stable region. According to one specific embodiment of the present invention, the matrix may comprise about 40 to about 70 percent by weight of the superabrasive material 100, with the superabrasive regions 104 being the balance.

Figure 2:
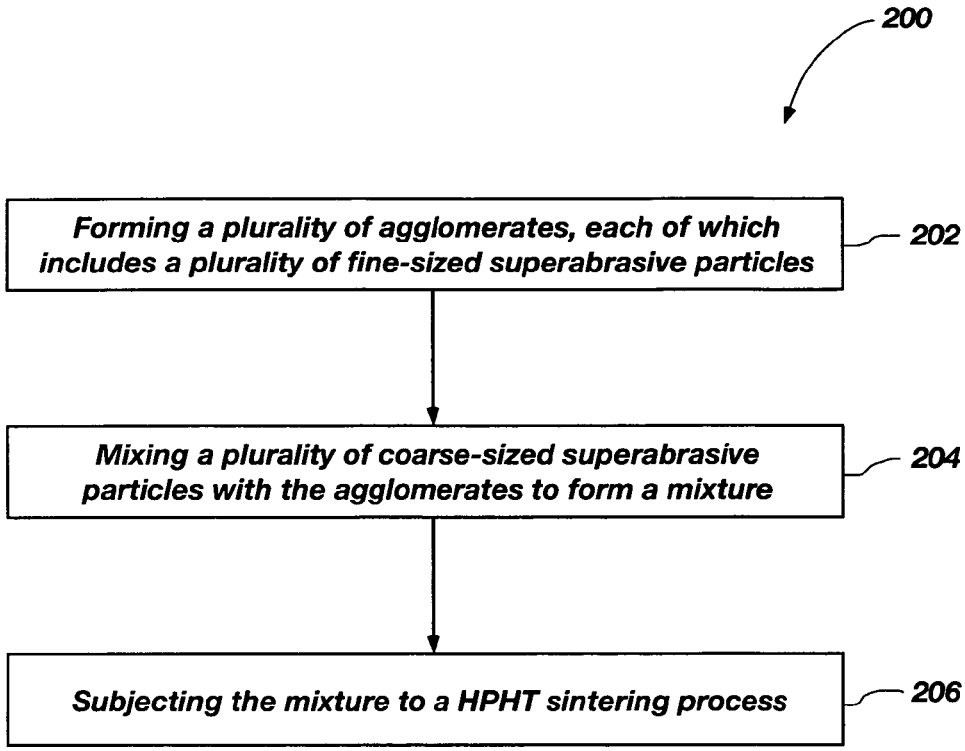
FIG. 2 is a flow diagram illustrating a method of fabricating the superabrasive material shown in FIG. 1 according to one embodiment of the present invention.

FIG. 2 is a flow diagram illustrating a method 200 of fabricating the superabrasive material 100 shown in FIG. 1 according to one embodiment of the present invention. In act 202, a plurality of agglomerates, each of which includes a plurality of fine-sized superabrasive particles (e.g., diamond particles, cubic boron nitride particles, or mixtures thereof) exhibiting a fine-sized average particle size, may be formed. According to various embodiments, the plurality of agglomerates may be formed by freeze drying, spray-drying, sieve granulation, or another suitable technique. For example, in freeze drying, the fine-sized superabrasive particles, a solvent, a dispersant, and a binder may be injected through a nozzle and into a liquid nitrogen bath to form generally spherical agglomerates. In one embodiment, the plurality of agglomerates may be formed according to any of the techniques disclosed in U.S. patent application Ser. No. 11/424,674. In some embodiments, a sintering aid, such as a metal-solvent catalyst may also be mixed with the fine-sized superabrasive particles, solvent, dispersant, and binder.

Still referring to FIG. 2, in act 204, a plurality of coarse-sized superabrasive particles (e.g., diamond particles, cubic boron nitride particles, or mixtures of both) may be mixed with the plurality of agglomerates to form a mixture. A Turbula® mixing machine or other suitable apparatus or technique may be used to generally uniformly disperse the agglomerates through the plurality of coarse-sized superabrasive particles without breaking apart the agglomerates. In another embodiment for act 204, the agglomerates may be immersed in a slurry comprising the coarse-sized superabrasive particles so that each agglomerate may be at least partially or completely coated with a plurality of the coarse-sized superabrasive particles. In such an embodiment, a plurality of the coated agglomerates may also be considered and referred to as the "mixture."

The coarse-sized superabrasive particles may exhibit a coarse-sized average particle size of about 6 μm to about 30 μm, and the fine-sized superabrasive particles may exhibit a fine-sized average particle size of about 6 μm or less. In some embodiments of the present invention, the coarse-sized average particle size of the coarse-sized superabrasive particles is about five times or more than the fine-sized average particle size of the fine-sized superabrasive particles of the agglomerates. Additionally, in some embodiments, the coarse-sized superabrasive particles may exhibit a bimodal or greater size distribution, while the coarse-sized average particle size is still greater than that of the fine-sized average particle size. However, an average size (i.e., a diameter or other cross-sectional dimension) of the agglomerates may be about 50 μm to about 200 μm. Each agglomerate may exhibit a selected geometry, such as a generally ellipsoid geometry, a generally spherical geometry, a non-spherical geometry, a generally cylindrical geometry, or another selected geometry. Non-spherically-shaped agglomerates may be formed by initially forming the agglomerates to exhibit the non-spherical shape or forming the agglomerates to exhibit a generally spherical geometry and compacting the agglomerates with rollers to form non-spherically-shaped particles. Furthermore, the plurality of agglomerates may comprise a mixture of differently shaped agglomerates, which may improve packing density.

In act 206, the mixture is subjected to an HPHT sintering process in the presence of a sintering aid, such as a metal-solvent catalyst comprising any of the previously mentioned metal-solvent catalysts. The metal-solvent catalyst may be in the form of metal-solvent-catalyst particles that are mixed in with the mixture prior to the HPHT sintering process or the metal-solvent catalyst may be in the form a metal-solvent-catalyst foil or green layer of metal-solvent catalyst placed adjacent to the mixture prior to the HPHT sintering process. Despite the relatively fine-size and relatively high-surface area of the fine-sized superabrasive particles that comprise each agglomerate, the metal-solvent catalyst may still effectively wet the fine-sized superabrasive particles to promote growth and bonding between adjacent fine-sized superabrasive particles and the coarse-sized superabrasive particles. This is currently believed by the inventor to be as a result of the proportion of the agglomerates in the mixture being sufficiently low (e.g., about less than 70 percent by weight) so that the collective surface area of the fine-sized superabrasive particles is sufficiently low.

In order to efficiently sinter the mixture, the mixture may be placed in a pressure transmitting medium, such as a refractory metal can, graphite structure, pyrophyllite and/or other pressure transmitting structure, or another suitable container or supporting element. The pressure transmitting medium, including the mixture, is subjected to an HPHT process using an ultra-high pressure press at a temperature of at least about 1000° Celsius (e.g., about 1100° Celsius to about 2200° Celsius) and a pressure of at least about 40 kilobar (e.g., about 50 kilobar to about 80 kilobar) for a time sufficient to sinter and form the superabrasive material 100 shown in FIG. 1.

Figure 3:
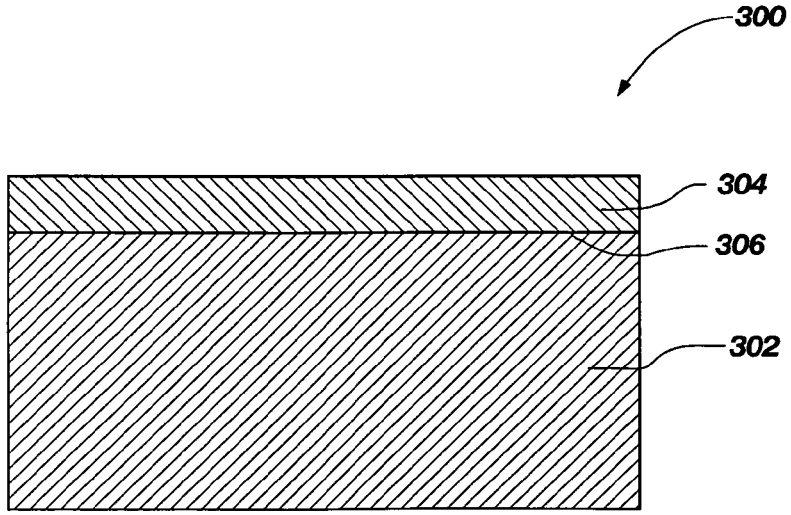
FIG. 3 is a cross-sectional view of a superabrasive compact including a superabrasive table that comprises the superabrasive material of FIG. 1 according to another embodiment of the present invention.

Referring to FIG. 3, the superabrasive material 100 may be employed in a superabrasive compact for cutting applications, bearing applications, or many other applications. FIG. 3 is a cross-sectional view of a superabrasive compact 300 according to another embodiment of the present invention. The superabrasive compact 300 includes a substrate 302 bonded to a superabrasive table 304 that comprises the superabrasive material 100. The substrate 302 may be generally cylindrical or another selected configuration, without limitation. Although FIG. 3 shows the interfacial surface 306 as being substantially planar, the interfacial surface 306 may exhibit a selected non-planar topography, without limitation. The substrate 302 may include a metal-solvent catalyst, such as cobalt in cobalt-cemented tungsten carbide or another suitable material. Other materials that may be used for the substrate 302 include, without limitation, cemented carbides including titanium carbide, niobium carbide, tantalum carbide, vanadium carbide, and combinations of any of the preceding carbides cemented with cobalt, iron, nickel, or alloys thereof.

Figure 4:
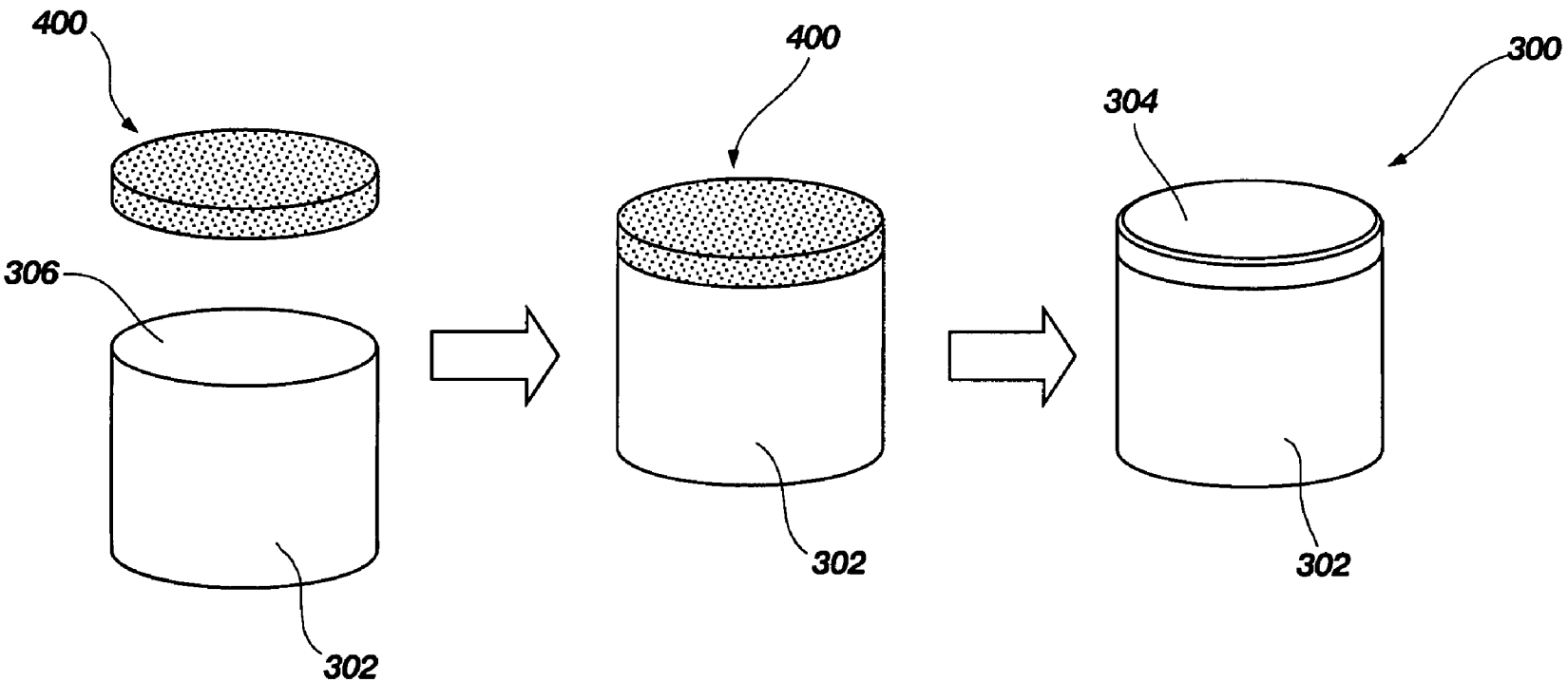
FIG. 4 is a schematic illustration of a process for fabricating the superabrasive compact shown in FIG. 3 according to another embodiment of the present invention.

FIG. 4 shows a schematic illustration of a process for fabricating the superabrasive compact 300 shown in FIG. 3 according to another embodiment of the present invention. Referring to FIG. 4, a mixture 400 (i.e., a plurality of agglomerates mixed with a plurality of coarse-sized superabrasive particles as previously described with respect to the method 200 shown in FIG. 2) is positioned adjacent to the interfacial surface 306 of the substrate 302. As previously discussed, the substrate 302 may include a metal-solvent catalyst. The mixture 400 and the substrate 302 may be subjected to an HPHT sintering process using conditions previously described with respect to the method 200 of FIG. 2 to form the superabrasive compact 300. The superabrasive compact 300 includes a superabrasive table 304 that comprises the superabrasive material 100 of FIG. 1 bonded to the interfacial surface 306 of the substrate 302. If the substrate 302 includes a metal-solvent catalyst, the metal-solvent catalyst may infiltrate the mixture 400 to promote growth between adjacent coarse-sized superabrasive particles, adjacent fine-sized superabrasive particles, and adjacent coarse-sized superabrasive particles and fine-sized superabrasive particles.

In other embodiments of the present invention, the superabrasive table 304 may be separately formed using an HPHT sintering process and, subsequently, bonded to the interfacial surface 306 of the substrate 302 by brazing, using a separate HPHT bonding process, or any other suitable joining technique, without limitation. In yet another embodiment of the present invention, the substrate may be formed by depositing a binderless carbide (e.g., tungsten carbide) via chemical vapor deposition onto the separately formed superabrasive table.

In any of the embodiments disclosed herein, substantially all or a selected portion metal-solvent catalyst may be removed (e.g., via leaching) from the superabrasive material so-formed. For example, substantially all or a selected portion metal-solvent catalyst may be removed from the superabrasive table 304 so-formed in the superabrasive compact 300.

It is noted that the superabrasive material 100 described with respect to FIG. 1 is depicted with the superabrasive grains 102 of the matrix exhibiting a high-degree of intercrystalline bonding, and the superabrasive grains 106 of the superabrasive regions 104 also exhibiting a high-degree of intercrystalline bonding. However, in another embodiment of the present invention, at least a portion of the superabrasive grains 102, superabrasive grains 106, and/or the superabrasive grains 102 and 106 may be bonded together with a bonding medium. For example, the superabrasive grains 102, superabrasive grains 106, or both may be diamond grains, with at least a portion of the superabrasive grains 102, superabrasive grains 106, and/or the superabrasive grains 102 and 106 bonded together with silicon carbide formed as a reaction product between the diamond grains and silicon mixed with the precursor diamond particles prior to HPHT sintering. Additionally, the agglomerates and/or the coarse-sized superabrasive particles of the mixture subjected the HPHT sintering process may comprise metal-carbide particles (e.g., tungsten carbide particles), silicon carbide particles, or both that may be retained in the superabrasive material 100 after HPHT sintering.

Figure 5:
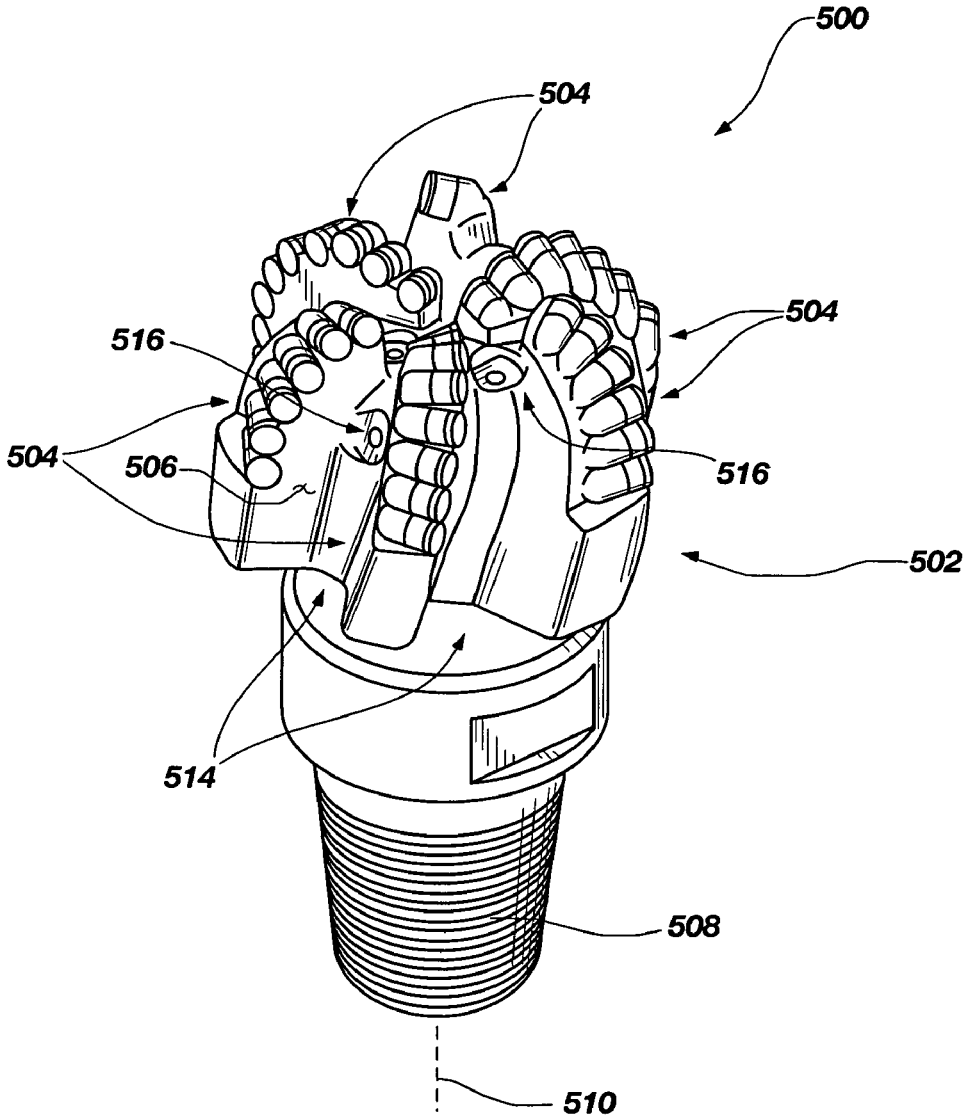
FIG. 5 is an isometric view of a rotary drill bit according to one embodiment of the present invention that may employ one or more of the superabrasive compacts encompassed by the various embodiments of the present invention.
Figure 6:
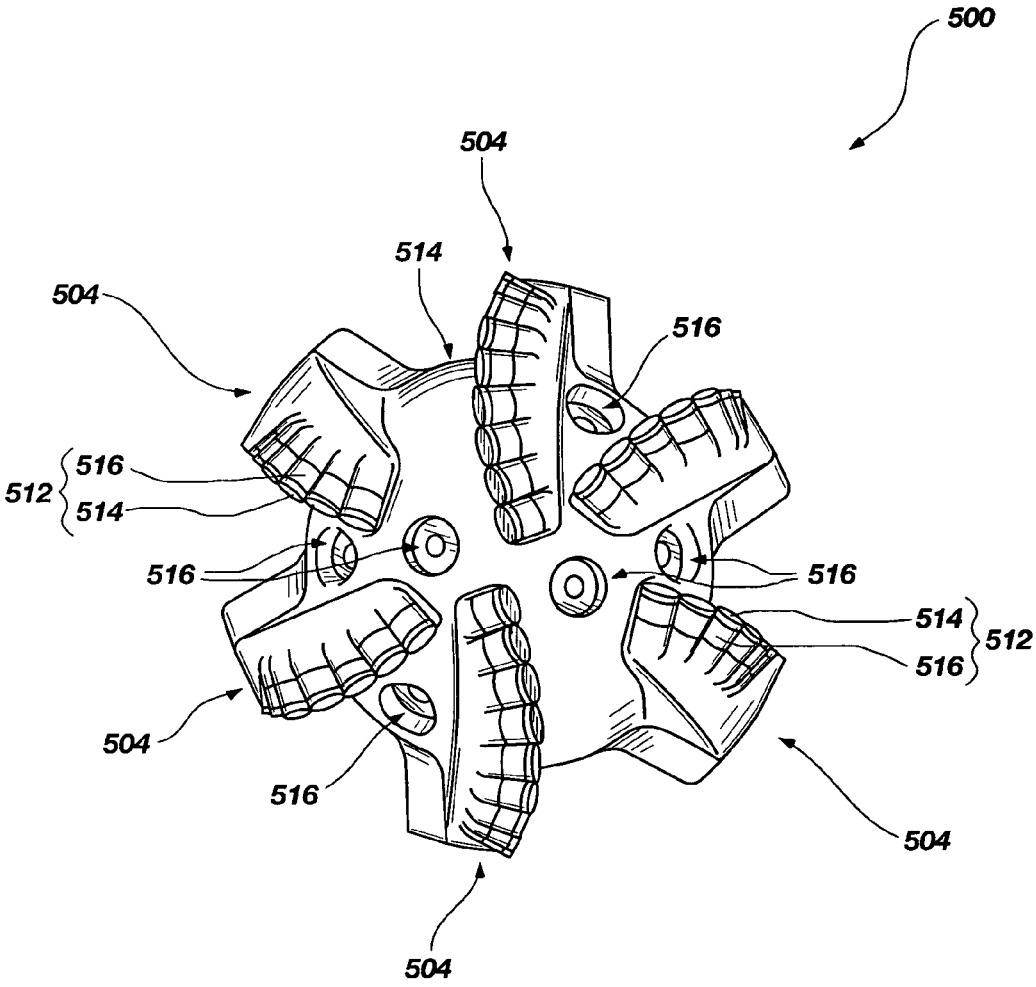
FIG. 6 is a top elevation view of the rotary drill bit shown in FIG. 5.

FIG. 5 is an isometric view and FIG. 6 is a top elevation view of a rotary drill bit 500 according to one embodiment of the present invention. The rotary drill bit 500 includes at least one superabrasive compact configured according to any of the previously described superabrasive compact embodiments.

The rotary drill bit 500 comprises a bit body 502 that includes radially and longitudinally extending blades 504 with leading faces 506, and a threaded pin connection 508 for connecting the bit body 502 to a drilling string. The bit body 502 defines a leading end structure for drilling into a subterranean formation by rotation about a longitudinal axis 510 and application of weight-on-bit. At least one superabrasive compact, configured according to any of the previously described superabrasive compact embodiments, may be affixed to rotary drill bit 500. With reference to FIG. 6, a plurality of superabrasive compacts 512 are secured to the blades 504. For example, each superabrasive compact 512 may include a superabrasive table 514 bonded to a substrate 516. More generally, the superabrasive compacts 512 may comprise any superabrasive compact disclosed herein, without limitation. In addition, if desired, in some embodiments of the present invention, a number of the superabrasive compacts 512 may be conventional in construction. Also, circumferentially adjacent blades 504 define so-called junk slots 514 therebetween, as known in the art. Additionally, the rotary drill bit 500 includes a plurality of nozzle cavities 516 for communicating drilling fluid from the interior of the rotary drill bit 500 to the superabrasive compacts 512.

FIGS. 5 and 6 merely depict one embodiment of a rotary drill bit that employs at least one cutting element that comprises a superabrasive compact fabricated and structured in accordance with the disclosed embodiments, without limitation. The rotary drill bit 500 is used to represent any number of earth-boring tools or drilling tools, including, for example, core bits, roller-cone bits, fixed-cutter bits, eccentric bits, bicenter bits, reamers, reamer wings, or any other downhole tool including superabrasive compacts, without limitation.

The superabrasive compacts disclosed herein (e.g., the superabrasive compact 300 shown in FIG. 3) may also be utilized in applications other than cutting technology. For example, the disclosed superabrasive compact embodiments may be used in wire dies, bearings, artificial joints, inserts, cutting elements, and heat sinks. Thus, any of the superabrasive compacts disclosed herein may be employed in an article of manufacture including at least one superabrasive element or compact.

Thus, the embodiments of superabrasive compacts disclosed herein may be used on any apparatus or structure in which at least one conventional PDC is typically used. For example, in one embodiment of the present invention, a rotor and a stator (i.e., a thrust bearing apparatus) may each include a superabrasive compact (e.g., the superabrasive compact 300 shown in FIG. 3) according to any of the embodiments disclosed herein and may be operably assembled to a downhole drilling assembly. U.S. Pat. Nos. 4,410,054; 4,560,014; 5,364,192; 5,368,398; and 5,480,233, the disclosure of each of which is incorporated herein, in its entirety, by this reference, disclose subterranean drilling systems within which bearing apparatuses utilizing superabrasive compacts disclosed herein may be incorporated. The embodiments of superabrasive compacts disclosed herein may also form all or part of heat sinks, wire dies, bearing elements, cutting elements, cutting inserts (e.g., on a roller cone type drill bit), machining inserts, or any other article of manufacture as known in the art. Other examples of articles of manufacture that may use any of the superabrasive compacts disclosed herein are disclosed in U.S. Pat. Nos. 4,811,801; 4,274,900; 4,268,276; 4,468,138; 4,738,322; 4,913,247; 5,016,718; 5,092,687; 5,120,327; 5,135,061; 5,154,245; 5,460,233; 5,544,713; and 6,793,681, the disclosure of each of which is incorporated herein, in its entirety, by this reference.

Although the present invention has been disclosed and described by way of some embodiments, it is apparent to those skilled in the art that several modifications to the described embodiments, as well as other embodiments of the present invention are possible without departing from the spirit and scope of the present invention. Additionally, the words "including," "having," and variants thereof (e.g., "includes" and "has") as used herein, including the claims, shall have the same meaning as the word "comprising" and variants thereof (e.g., "comprise" and "comprises") and mean "including, but not limited to."

The invention claimed is:

1. A superabrasive material, comprising:

a matrix including a plurality of coarse-sized superabrasive grains, the coarse-sized superabrasive grains exhibiting a coarse-sized average grain size of about 6 μm to about 20 μm; and a plurality of superabrasive regions dispersed within the matrix, each of the superabrasive regions including a plurality of fine-sized superabrasive grains exhibiting a fine-sized average grain size less than the coarse-sized average grain size, each of the superabrasive regions exhibiting an average size of about 50 μm to about 200 μm.

2. The superabrasive material of claim 1 wherein the matrix comprises a substantially continuous matrix.

3. The superabrasive material of claim 1 wherein each of the superabrasive regions exhibits an average size that is greater than the coarse-sized average grain size.

4. The superabrasive material of claim 1 wherein the fine-sized average grain size of each of the superabrasive regions is about 6 μm or less.

5. The superabrasive material of claim 1 wherein the coarse-sized average grain size of the matrix is about 5 times or more than the fine-sized average grain size of the superabrasive regions.

6. The superabrasive material of claim 1 wherein each of the superabrasive regions exhibits a generally cylindrical geometry or a generally ellipsoid geometry.

7. The superabrasive material of claim 1 wherein:

the coarse-sized superabrasive grains of the matrix comprise polycrystalline diamond, polycrystalline boron nitride, or mixtures thereof; and each of the superabrasive regions comprises polycrystalline diamond, polycrystalline boron nitride, tungsten carbide, silicon carbide, or mixtures thereof.

8. The superabrasive material of claim 1 wherein:

the plurality of coarse-sized superabrasive grains defines a plurality of first interstitial regions; the plurality of fine-sized superabrasive grains defines a plurality of second interstitial regions; and the first and second interstitial regions include metal-solvent catalyst disposed therein.

9. The superabrasive material of claim 8 wherein the metal-solvent catalyst comprises cobalt, nickel, iron, or alloys thereof.

10. The superabrasive material of claim 8 wherein at least a portion of the first and the second interstitial regions are substantially free of the metal-solvent catalyst.

11. A superabrasive compact, comprising:

a superabrasive table comprising: a matrix including a plurality of coarse-sized superabrasive grains, the coarse-sized superabrasive grains exhibiting a coarse-sized average grain size of about 6 μm to about 20 μm; and a plurality of superabrasive regions dispersed within the matrix, each of the superabrasive regions including a plurality of fine-sized superabrasive grains exhibiting a fine-sized average grain size less than the coarse-sized average grain size, each of the superabrasive regions exhibiting an average size of about 50 μm to about 200 μm; and a substrate bonded to the superabrasive table.

12. The superabrasive compact of claim 11 wherein the substrate comprises a binderless carbide material or a cemented-carbide material.

13. A method, comprising:

providing a plurality of coarse-sized superabrasive particles, the coarse-sized superabrasive particles exhibiting a coarse-sized average particle size; forming a plurality of agglomerates, each of the agglomerates including a plurality of fine-sized superabrasive particles exhibiting a fine-sized average particle size less than the coarse-sized average particle size; mixing the plurality of agglomerates with the plurality of coarse-sized superabrasive particles to form a mixture; and sintering the mixture to form a superabrasive material.

14. The method of claim 13 wherein sintering the mixture to form a superabrasive material comprises: exposing the mixture to at least about 40 kilobar; and heating the mixture to at least about 1000° Celsius.

15. The method of claim 13 wherein forming a plurality of agglomerates comprises at least one of freeze drying, spray-drying, or sieve granulating the plurality of fine-sized superabrasive particles to form the plurality of agglomerates.

16. The method of claim 13, further comprising: selecting each of the agglomerates to exhibit an average size that is greater than the coarse-sized average particle size of the plurality of coarse-sized superabrasive particles.

17. The method of claim 13, further comprising: forming each of the agglomerates to exhibit an average size of about 50 μm to about 200 μm; and selecting the coarse-sized average particle size of the plurality of coarse-sized superabrasive particles to be about 6 μm to about 20 μm.

18. The method of claim 13, further comprising: selecting the coarse-sized average particle size of the plurality of coarse-sized superabrasive particles to be about 10 μm to about 30 μm; and selecting the fine-sized average particle size of each of the agglomerates to be about 6 μm or less.

19. The method of claim 13, further comprising: forming each of the agglomerates to exhibit a generally cylindrical geometry or a generally ellipsoid geometry.

20. The method of claim 13, further comprising: prior to the act of sintering the mixture to form the superabrasive material, positioning the mixture adjacent to a substrate.

21. A method, comprising:

forming a plurality of agglomerates by at least one of freeze drying, spray-drying, or sieve granulation, each of the agglomerates including a plurality of fine-sized superabrasive particles exhibiting a fine-sized average particle size; mixing the plurality of agglomerates with a plurality of coarse-sized superabrasive particles to form a mixture, the coarse-sized superabrasive particles exhibiting a coarse-sized average particle size greater than the fine-sized average particle size; and sintering the mixture to form a superabrasive material.

22. The method of claim 21 wherein mixing the plurality of agglomerates with a plurality of coarse-sized superabrasive particles to form a mixture comprises mixing the plurality of agglomerates with the plurality of coarse-sized superabrasive particles so that the plurality of agglomerates do not substantially break apart during the mixing.

* * * * *